US006565448B2

(12) United States Patent
Cameron et al.

(10) Patent No.: US 6,565,448 B2
(45) **Date of Patent: *May 20, 2003**

(54) METHOD AND APPARATUS FOR CONFIGURING A GOLF CLUB IN ACCORDANCE WITH A GOLFER'S INDIVIDUAL SWING CHARACTERISTICS

(75) Inventors: Don T. Cameron, Carlsbad, CA (US); August L. Slivnik, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/881,625

(22) Filed: Jun. 12, 2001

(65) Prior Publication Data

US 2001/0029207 A1 Oct. 11, 2001

Related U.S. Application Data

(63) Continuation of application No. 09/156,540, filed on Sep. 17, 1998.

(51) Int. Cl.[7] ..... A63B 53/00
(52) U.S. Cl. ..... 473/131; 473/407; 473/409
(58) Field of Search ..... 434/247, 252, 434/251; 473/233, 239, 223, 131, 407, 409, 288, 289, 199, 202; 73/491; 348/838, 579; 312/114

(56) References Cited

U.S. PATENT DOCUMENTS 4,063,259 A 12/1977 Lynch et al.
4,160,942 A 7/1979 Lynch et al.
4,375,887 A 3/1983 Lynch et al.
4,545,576 A 10/1985 Harris
4,713,686 A 12/1987 Ozaki et al.
4,755,881 A 7/1988 Bartlett
4,860,096 A 8/1989 Long et al.
4,891,748 A 1/1990 Mann
5,111,410 A 5/1992 Nakayama et al.
5,154,427 A 10/1992 Harlan et al.
5,184,295 A 2/1993 Mann
5,210,603 A 5/1993 Sabin et al.
5,249,967 A 10/1993 O'Leary et al.
5,333,061 A 7/1994 Nakashima et al.
5,342,054 A 8/1994 Chang et al.

(List continued on next page.)

OTHER PUBLICATIONS

Kodak ® Motioncorder Analyzer, Model 1000 ™ video camera (1996).
Neat Systems, Inc., The NEAT System Never Ending Athletic Trainer CD–Rom, Version 3.0 (1996).

*Primary Examiner*—Michael O'Neill
(74) *Attorney, Agent, or Firm*—Swidler Berlin Shereff Friedman, LLP

(57) ABSTRACT

An apparatus and method is provided for analyzing a golfer's individual swing attributes and determining, based on that analysis, a suitable golf club configuration for that golfer. The swing analysis apparatus include video cameras for obtaining video images of a golfer swinging a golf club, such as a putter, at a golf ball. Images obtained from the video cameras may then be analyzed to determine what golf club dimensions will provide improved results in combination with the golfer's individual swing characteristics. The apparatus may additionally include a golf club having predetermined dimensions. When such a golf club is included, images from the video cameras may be analyzed to determine how the golf club of known dimensions must be adjusted to provide the golfer with desirable swing results. The apparatus may also include a method for confirming the dimensions that it is believed will provide a golfer with improve swing results. Such methods include an analysis of the performance of a golf ball following impact with the golf club, and an analysis of the golfer's wrist and head movement during the golf swing.

13 Claims, 8 Drawing Sheets

U.S. PATENT DOCUMENTS

| | | | |
|---|---|---|---|
| 5,441,256 | A | 8/1995 | Hackman |
| 5,472,205 | A | 12/1995 | Bouton et al. |
| 5,486,001 | A | 1/1996 | Baker |
| 5,501,463 | A | 3/1996 | Gobush et al. |
| 5,575,719 | A | 11/1996 | Gobush et al. |
| 5,591,091 | A | 1/1997 | Hackman |
| 5,697,791 | A | 12/1997 | Nashner et al. |
| 5,772,522 | A | 6/1998 | Nesbit et al. |
| 5,797,805 | A | 8/1998 | Lubell et al. |
| 5,821,417 | A | 10/1998 | Nauro et al. |
| 5,823,387 | A | 10/1998 | Manadanas et al. |
| 5,827,127 | A | 10/1998 | Firth |
| 5,864,960 | A | 2/1999 | DeNicolo et al. |
| 5,911,636 | A | 6/1999 | Schmoll |
| 5,951,410 | A | 9/1999 | Butler et al. |
| 6,041,651 | A | 3/2000 | Nauro et al. |

METHOD AND APPARATUS FOR CONFIGURING A GOLF CLUB IN ACCORDANCE WITH A GOLFER'S INDIVIDUAL SWING CHARACTERISTICS

This is a continuation of application Ser. No. 09/156,540, filed Sep. 17, 1998, pending.

COPYRIGHT AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND OF THE INVENTION

1. Technical Field

The present invention relates generally to equipment used in the game of golf. More particularly, the present invention relates to a method and apparatus for custom fitting a golf club in accordance with a golfer's individual swing characteristics.

2. Discussion of the Related Art

In recent years, technology relating to the game of golf has evolved rapidly, with many different systems having been implemented for improving the quality of play and the quality of the equipment utilized. For example, U.S. Pat. Nos. 4,375,887 and 4,063,259 disclose methods of analyzing golf ball flight characteristics upon impact with a golf club. Likewise, U.S. Pat. Nos. 5,342,054; 5,697,791; 5,486,001; 5,472,205; 5,249,967; 5,154,427; 5,111,410; and 4,713,686 disclose systems and methods for analyzing a golfer's swing, and providing feedback to the golfer based thereon. U.S. Pat. Nos. 4,063,259 and 4,375,887 disclose techniques for detecting golf club head position, and golf ball position, shortly after impact using photoelectric means to trigger a flash so as to permit a photograph to be taken of the club head. U.S. Pat. Nos. 5,501,463 and 5,575,719 disclose techniques for detecting club head position shortly after impact using cameras capable of receiving light from multiple reflectors placed on the club head prior to the swing.

However, while numerous golf swing analysis, ball trajectory analysis, and club head detection systems have been implemented, there exists a need in the art for a fully satisfactory apparatus and method to review and analyze a golfer's individual swing characteristics, and then configure a golf club in accordance with those characteristics.

SUMMARY OF THE INVENTION

It is therefore an object of the present invention to provide an apparatus and method for analyzing a golfer's individual swing attributes and determining based on that analysis, a suitable golf club configuration for that golfer.

In one exemplary embodiment of the invention, an apparatus is provided that includes a striking location for receiving a golf ball to be struck. The apparatus further includes video camera means, such as high speed video cameras, directed at the striking location for obtaining video images of a golf club during a golfer's swing at the golf ball in the striking area. A means for receiving and storing the video images from the video cameras is also included, along with a means for initiating the storage of video images from the video cameras. A display, such as a computer monitor, is used for displaying the stored video images of the golfer's swing. In addition, a means is included for analyzing the displayed video images of the golfer's swing and determining based on that analysis what golf club dimensions will provide desired results in combination with that golfer's swing.

In yet another exemplary embodiment of the invention, the apparatus additionally includes a golf club, such as a putter, having predetermined dimensions. In this embodiment of the invention, a means is provided for determining, from an analysis of a golfer's swing with the golf club, the amount the dimensions of that golf club must be adjusted to provide the golfer with desirable swing results. Such dimensions would include, for example, the lie and loft of the golf club.

The apparatus may additionally include a means for confirming the club dimensions that are expected to provide a golfer with desired swing results. Means to confirm the appropriate dimensions include an analysis of the performance of a golf ball following impact with the golf club, or an analysis of the golfer's wrist and head movement during the golf swing.

In yet another exemplary embodiment of the invention, a method for configuring a golf club in accordance with an individual golfer's swing is provided. In this embodiment of the invention, a golfer is provided with a golf club of predetermined dimensions, such as a putter. A golf ball is then positioned and aligned in a striking area so that video cameras aimed at the striking area will obtain video images of a golfer's swing while using the golf club. Thereafter, the golfer is instructed to proceed with his or her own golf swing, while at approximately the same time, one or more of the video cameras are activated. Images obtained by the video cameras during the golfer's swing are then captured and stored. From these stored video images, the position of the golf club during the golfer's swing, and the results obtained from that swing, may then be determined. Based on the position of the golf club during the golfer's swing and the results obtained using the golf club of known dimensions, a golf club may then be customized in accordance with that golfer's individual swing characteristics.

BRIEF DESCRIPTION OF THE DRAWINGS

The features and advantages of the present invention will be better understood by reference to the following detailed description, which should be read in conjunction with the accompanying drawings in which.

DETAILED DESCRIPTION OF THE INVENTION

The following embodiments of the present invention will be described in the context of golf putters, and the custom fitting of golf putters, although those skilled in the art will recognize that the disclosed methods and structures are readily adaptable for broader application.

Figure 1:
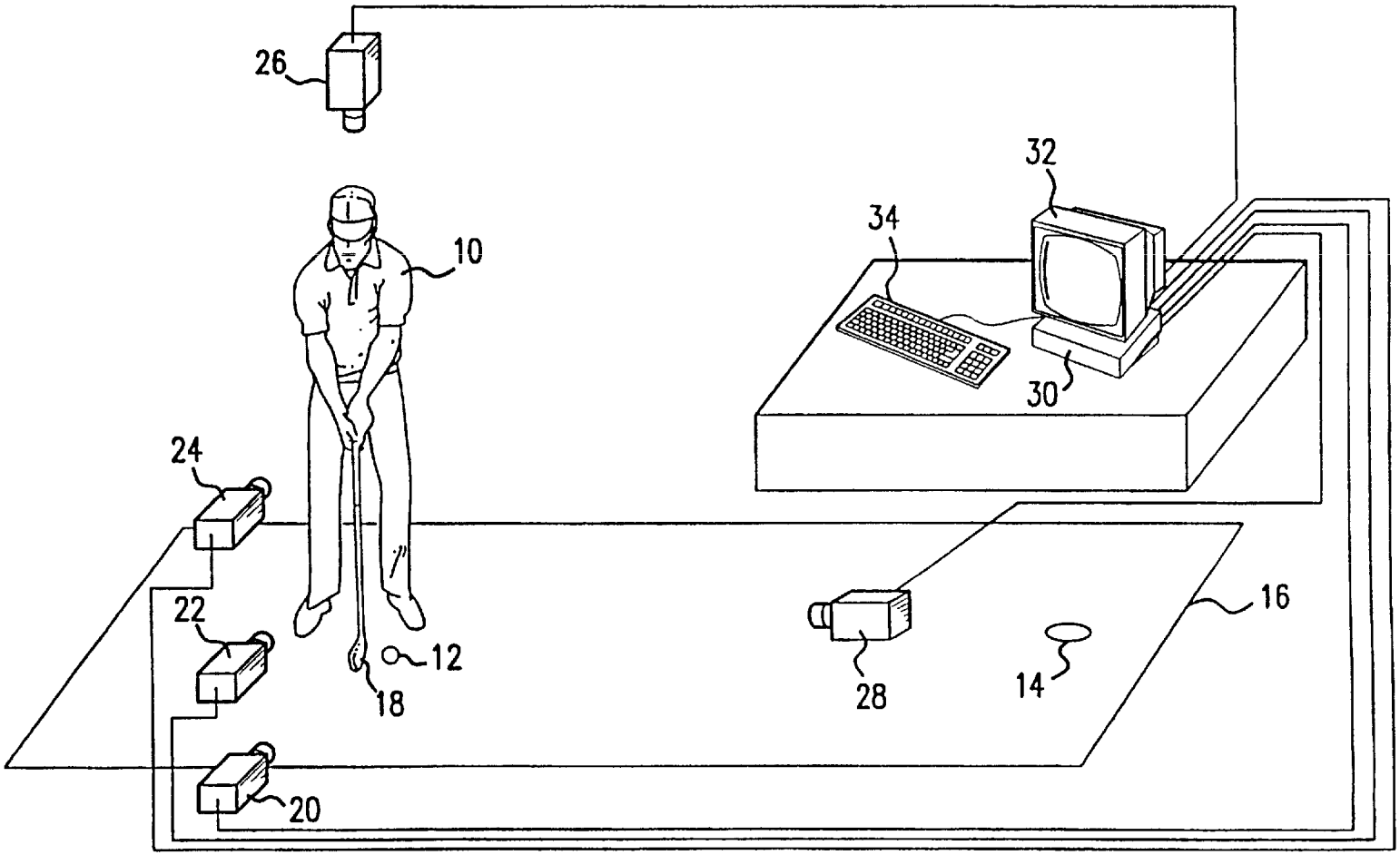
FIG. 1 is a schematic illustration of an apparatus constructed in accordance with the invention.

FIG. 1 discloses a putter analysis system according to one exemplary embodiment of the invention. As shown in FIG. 1, the system includes an artificial putting surface 16 with a hole 14, placed approximately 20 feet from the striking area, for receiving a golf ball 12. The system is suitable for either indoor or outdoor use, and further includes a ball side view camera 20, a shaft side view camera 22, a grip side view camera 24, an overhead view camera 26, and a forward facing camera 28. Each camera is preferably positioned near golfer 10 using any suitable, stable support means, but not so near as to interfere with the golfer's putting stroke. More specifically, ball side view camera 20 is preferably placed at ground level, or as close to ground level as possible, approximately 2–3 feet from golf ball 12 so as to capture close-up side-view images of the putter head and golf ball during the putting stroke. Shaft side view camera 22 may be placed directly above camera 20, approximately 1–2 feet from ground level, so as to obtain side images of the lower half of the golf club shaft during the putting stroke. Grip side view camera 24 is preferably placed directly above cameras 20 and 22, approximately 2–3 feet above ground level, so as to obtain close-up side images of the golfer's grip during the putting stroke. Overhead video camera 26 is mounted directly above the head of golfer 10, approximately 8–10 feet off the ground, so as to obtain images of the golfer's head and golf club swing plane during the putting stroke. Forward facing camera 28 is placed in the golfer's putting line, approximately 12 feet from the golf ball, so as to obtain images that reflect the position of the putter strike face during the putting stroke. Camera 28 should be placed as close to the ground as possible, but no closer than 2 inches, so that a standard 1.68" diameter golf ball will travel unimpeded to hole 14 if positioned beyond camera 28.

Although cameras 20, 22, 24, 26 and 28 may comprise any type of high speed video camera, one suitable camera is the Kodak® Motioncorder Analyzer, Model 1000™ video camera, which can record video images at speeds up to 600 frames per second from the above-referenced locations. While it is to be understood that any number of cameras and camera angles may be employed in accordance with the invention, preferably at least three cameras are employed (in particular, camera 20, camera 22 and camera 28 for better results). The five cameras located in the positions disclosed in FIG. 1 are merely illustrative of a preferred embodiment from which good results have been achieved. Persons of ordinary skill in the art may select the number of cameras and their locations according to desired results based on the teachings of the present invention. Additionally, if golfer 10 is a left-handed golfer, the positions of cameras 20, 22, and 24 would necessarily be opposite those positions set forth in FIG. 1.

The outputs of video cameras 20, 22, 24, 26, and 28 are connected to a computer 30, which includes an attached monitor 32 and keyboard 34. In one embodiment of the invention, computer 30 is an IBM-compatible personal computer with a Pentium® Processor running at least Windows 95®, and includes a 17" Ultra VGA monitor 32. Depending on the desired means for storing images obtained from video cameras 20, 22, 24, 26, and 28, computer 30 may additionally be attached to a video cassette recorder (VCR), a DVD player, or a CD ROM (read only memory) drive (although neither a VCR, DVD player, or a CD ROM drive is shown in FIG. 1). In one exemplary embodiment of the invention, however, computer 30 includes a video capture card for converting video images captured from the attached cameras into standard AVI-format data files. These standard AVI-format data files may then be stored on the hard drive of computer 30, or on a CD ROM using an attached CD ROM drive. Although any video capture card may be used, one suitable capture card is the Intel® Smart Video Recorder Board™. If video images are to be captured from only one camera at a time, a video splitter box, such as a Radioshack® video splitter box, may be placed between the five video cameras and computer 30 to accomplish this objective.

Figure 2:
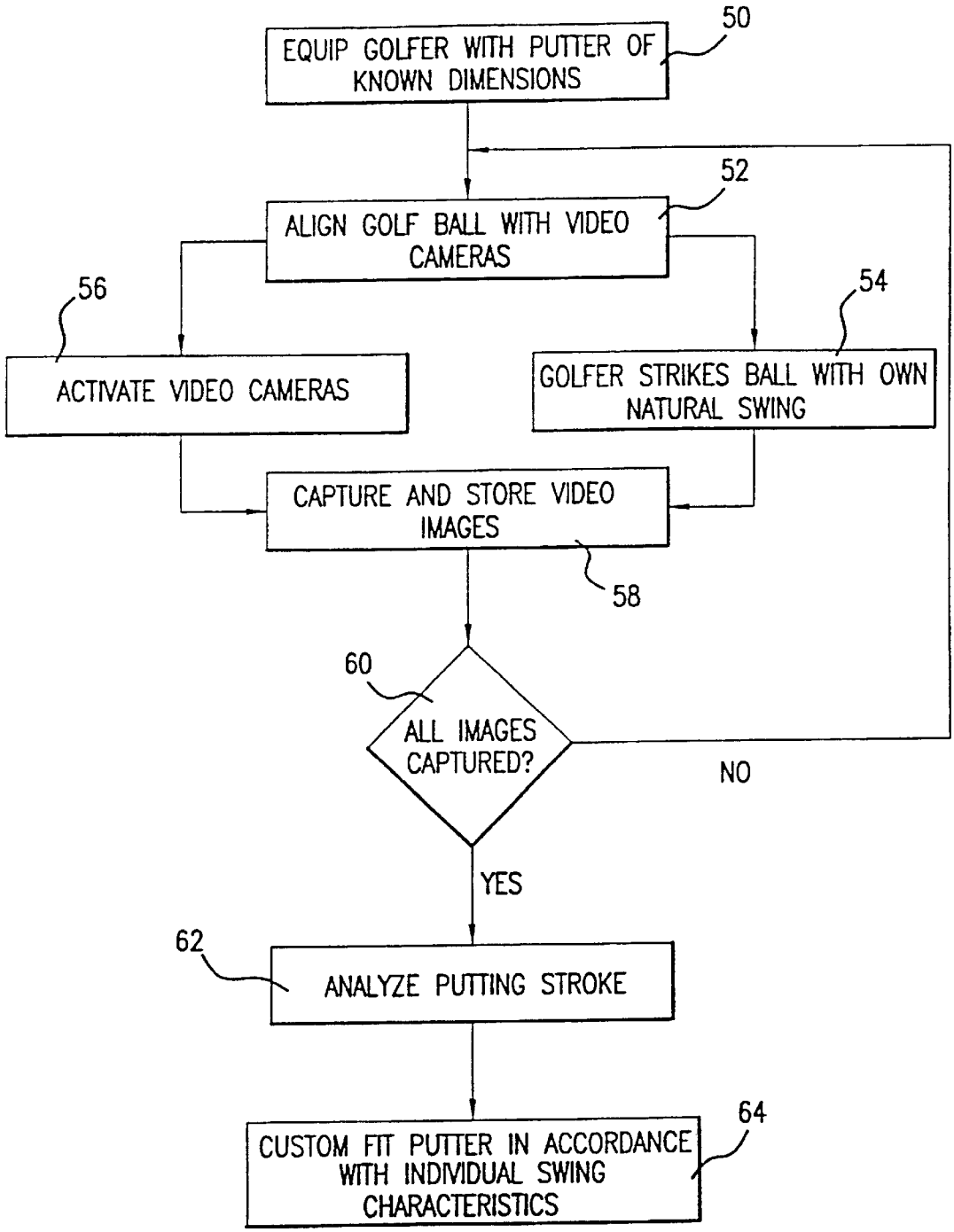
FIG. 2 is a flow chart setting forth an exemplary method of the invention for analyzing a golfer's swing, and custom fitting a golf club in accordance with that swing.
Figure 3B:
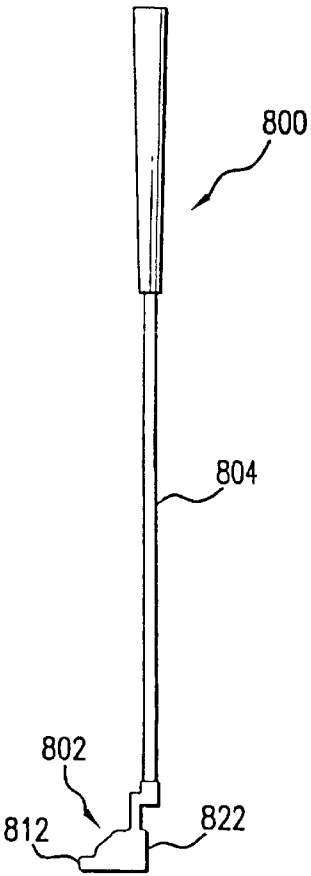
FIGS. 3A–B are, respectively, front and side views of a putter of known dimensions for use with the invention.
Figure 3A:
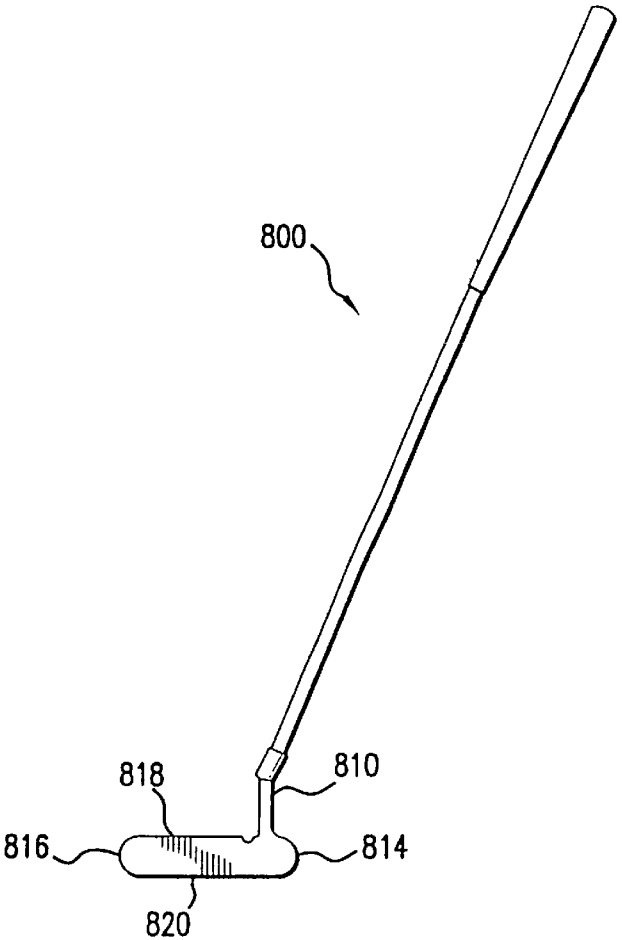

Turning now to FIG. 2, a flow chart is disclosed that sets forth a method, in accordance with the invention, for reviewing and analyzing a golfer's swing, and custom fitting a club (in this example a putter) to that swing. As shown in FIG. 2, a golfer 10 must first be equipped with a putter of known dimensions (step 50). One such putter is that disclosed in FIGS. 3A–B, which contains an exemplary putter head 802. Putter head 802 includes a hosel 810, a back face 812, a heel 814 and toe 816, a top ridge 818, a sole 820, and a front strike face 822. Front strike face 822 is flat, and is set at approximately a 4° loft with respect to a line perpendicular to sole 820. Putter head 802 and shaft 804 are configured such that putter 800 has a 71° lie.

Although golfer 10 may be equipped with any putter of known dimensions, equipping golfer 10 with putter 800 is additionally advantageous, as a putter with such dimensions is generally understood, when used properly, to provide desirable putting results. Accordingly, as is discussed below in detail, if desirable putting results are not obtained during the putting stroke, such information may be used when custom fitting a putter in accordance with the golfer's individual swing characteristics. Thus for example, it has been determined that, if the putter strike face has a 4° loft at impact with a golf ball, the golf ball will be imparted with a generally true roll, allowing the golfer to more easily control the direction of travel of the golf ball and the distance the ball travels. In contrast, if the loft of the putter strike face is less than 4° at impact (due, for example to a particular golfer's forward press which, one skilled in the art will understand, is a situation wherein the golfer allows his grip to travel ahead of the club face during the putting stroke), golf ball 12 may be driven into the putting surface. This causes the golf ball to hop off of the putting surface, resulting in reduced putting accuracy. Similarly, if the putter strike face has greater than a 4° loft at impact (due, for example to a particular golfer's rearward press which, one skilled in the art will understand, is a situation wherein the golfer allows his grip to travel behind the club face during the putting stroke), undesirable backspin may be imparted on golf ball 12, causing golf ball 12 to "check-up" upon contact with the putting surface, again resulting in a loss of putting accuracy. Since putter 800 is configured with a strike face 822 having a 4° loft, if putter 800 is utilized in a standard fashion (imparting no forward or rearward press during the stroke), strike face 822 will have a 4° loft at impact, resulting in desirable putting results. If it is found that strike face 822 does not have a 4° loft at impact (as a result of the golfer's swing), this information may be used, as explained in detail below, to customize a putter to that golfer's swing.

Figure 5:
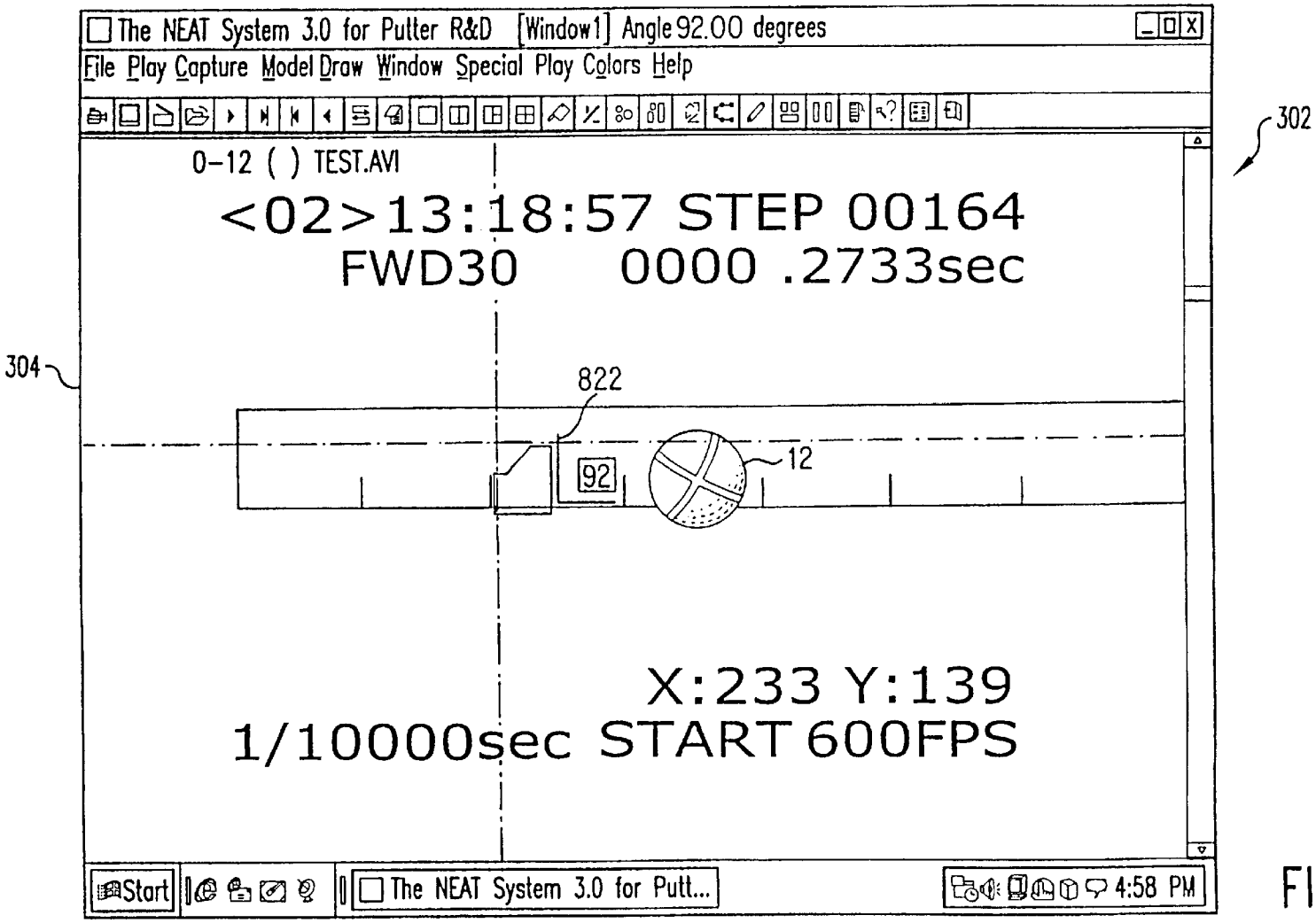
FIG. 5 is a computer display of a ball side view still image illustrating the method according to the present invention.

Once golfer 10 has been fitted with a golf club of known dimensions, golf ball 12 must be placed at a location on putting surface 16 (the striking area) that is within view of video camera 20 (step 52). As shown in FIG. 5 for example, dark-colored bands may be advantageously placed along two perpendicular circumferences of golf ball 12 prior to its placement in the striking area, allowing for more accurate analysis of golf ball movement following impact with the putter. Specifically, with dark-colored bands placed on golf ball 12, it is much easier, given the limitations on the quality of captured video images, to analyze the movement imparted on golf ball 12 once it is struck.

Once golf ball 12 is properly positioned with respect to cameras 20, 22, 24, 26, and 28, golfer 10 putts the ball with his or her own natural putting stroke (step 54). At approximately the same time golfer 10 initiates his or her putting stroke, or immediately before that time, one or more of the video cameras 20, 22, 24, 26, and 28 are activated (step 56). As is discussed in more detail below, activation of the video cameras may be accomplished manually by the system operator, or may be accomplished through a software routine in computer 30.

As is also discussed in more detail below, during the golfer's putting stroke, video images from the activated cameras are captured and stored using the video capture card and storage means of computer 30 (step 58). If video images from additional putting strokes are to be captured, or if video images from only one camera at a time are to be captured, golfer 10 may be instructed to proceed with additional putting strokes (step 60). However, if images are only being obtained from one camera at a time, the selection means on the video splitter box must be adjusted so that computer 30 will receive signals from the desired video camera before each successive putting stroke.

Once all desired images from the video cameras have been captured and stored digitally in data files, the golfer's putting stroke must then be analyzed (step 62). To facilitate this analysis, a sports training software system may be employed. One exemplary embodiment of a sports training software system is a modified version of the NEAT System 3.0—Never Ending Athletic Trainer™, available from Neat Systems, Inc., 133 Defense Highway, Suite 109, Annapolis, Md. 21401. As discussed below, the NEAT System 3.0 is modified, in accordance with the invention, to include both a detailed angular read-out for the system operator and the ability to be linked to multiple cameras (as opposed to single camera). It is to be understood, however, that although sports training software system is described using as an example NEAT System 3.0, any method or apparatus for graphically displaying and analyzing a golfer's stroke in accordance with the invention may be employed.

FIGS. 4–8 illustrate an exemplary embodiment of a graphical user interface 302 for the sports training software system. As shown in FIGS. 4–8, user interface 302 includes a video-image screen 304. Video-image screen 304 allows the user to view and analyze images captured from cameras 20, 22, 24, 26, and 28 using various functions of the putting analysis system relating to the display and analysis of a putting stroke. User interface 302 enables the user to select from and utilize these functions, functions which include capture video 310, review capture video 312, open video 314, forward play 316, forward step 318, reverse play 320, reverse step 322, window number 324, line 326, circle 328, rectangle 330, and angle 332. For clarification, the graphic buttons in user interface 302 that correspond to these various functions have been labelled with the matching function numbers in FIG. 4.

As mentioned, before the video images are to be analyzed, they must first be captured (step 58 in FIG. 2). This may be done using capture video 310 function. When the capture video button is depressed (button 310 in FIG. 4), the user interface of modified NEAT System will allow the user to select from one of the five available video cameras. Once a video camera is selected, the video camera may be controlled using the sports training software system. Specifically, NEAT System 3.0 can be modified to allow the user to control from the user interface the functions of the cameras being used. In the case of the Kodak® Motioncorder Analyzer, Model 1000™, these functions include trigger, mode, playback direction, stop/escape, and shutter speed/frame rate. By controlling the cameras from user interface 302, the system operator can capture a video image without leaving computer 30, and without having to manually control the video cameras from the video camera positions. These captured images may then stored as a data file using the video capture card of computer 30. If the user wishes to review the captured images prior to permanent storage on the hard drive of computer 30, or on a CD ROM, review capture file 312 function may be used (by depressing button 312 in FIG. 4) to play the captured video images back in real time.

Once all desired images have been captured and stored, a particular image to be reviewed and analyzed may be opened into video-image screen 304 using open video function 314 (by depressing button 314). Once selected, open video function 314 prompts the system operator for the file name and file path of the video-image file to be analyzed.

Once a video-image file is opened, various functions of the software system may be utilized to manipulate and analyze the video images. For example, if forward play 318 function is selected by depressing button 318, the opened video image will play back at normal, real-time speed in screen 304. If reverse play 320 function is chosen, the opened video image will play back in reverse at normal, real-time speed. If the user selects the forward step 320 or reverse step 324 functions, the captured video images will proceed in either forward or reverse fashion one frame at a time in screen 304. This sequential procession of frames is controlled by the user through buttons 320 and 324 in FIG. 4; each time these buttons are depressed, the video proceeds forward (or backward) one step or frame, which is equivalent, for example, to 0.00167 seconds if a 600 frame per second camera is being utilized. Using these functions, the user can advance to and then stop at any specific phase of the golfer's swing for more detailed analysis. Two appropriate stopping points for such an analysis are at the point of ball/club impact, or immediately thereafter.

Figure 4:
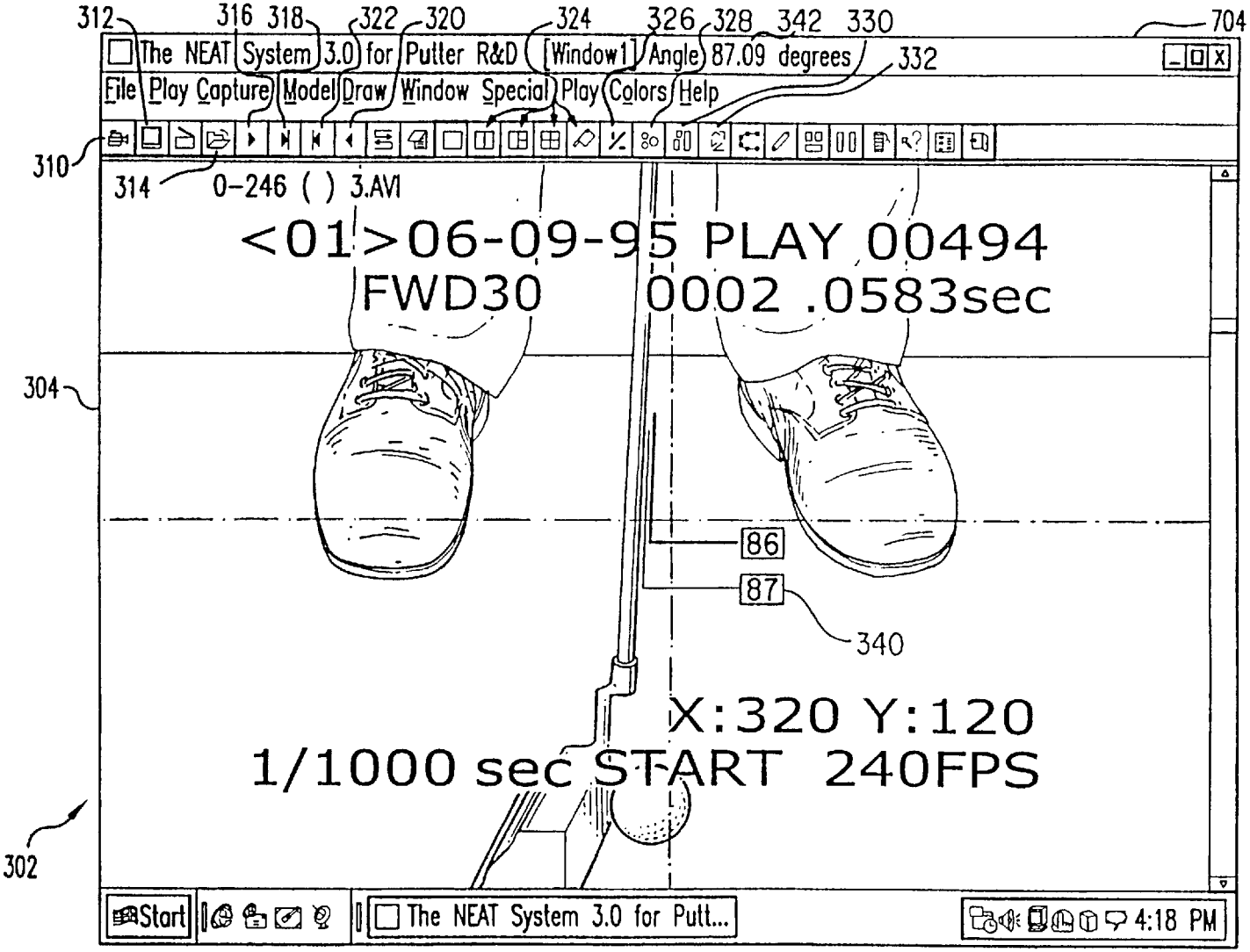
FIG. 4 is a computer display of a shaft side view still image illustrating the method according to the present invention.

An exemplary video image, wherein such an appropriate stopping point has been reached, is disclosed in screen 304 of FIG. 4. Specifically, screen 304 of FIG. 4 includes a shaft side view still image, previously captured from camera 22, obtained at the time the golf club impacts the ball. Once such an advantageous stopping point is reached, additional functions of the system may be used to analyze the golfer's putting stroke. This detailed analysis using additional system functions will now be described in the context of FIGS. 4–8.

As mentioned, FIG. 4 illustrates a shaft side view video image obtained at the time the golf club impacts the ball. Using angle function 332, the angle of the club shaft upon the putter's impact with the ball may be determined from this still image. In general, angle function 332 allows the user to draw two lines over image screen 304, said two lines connecting to form a vertex. The system will then compute and display the precise angle formed between these two lines.

Accordingly, to determine the club shaft angle at impact, the user first draws a line along the club shaft, and then connects to that line a horizontal line representing the putting surface. The putting analysis system will then compute and display the angle between these two lines, which represents the club shaft angle at impact with the ball. An example of two such lines, and the resulting angular read-out 340 (87 degrees in FIG. 4), can be seen in video image screen 304 of FIG. 4. In accordance with one previously-described modification to NEAT System 3.0, this angular reading is also displayed to two-decimal place accuracy (87.09 degrees in FIG. 4), at a second position 342 on the computer screen.

Using the obtained angular reading, it may be determined whether golfer 10 has a forward or rearward press of the putter at impact, and if so, the extent of the press. Thus, for example, if the obtained angular reading is 87°, as shown in FIG. 4, this would indicate that the golfer has a 3° forward press. This information may then be used to custom-fit a putter to that golfer's putting stroke (step 64 in FIG. 2). Specifically, if golfer 10 has a forward press upon impact with the ball, he or she is de-lofting the putter strike face 822 from its original, desired 4° angle. Accordingly, the strike face of golfer 10's putter should be additionally lofted by the amount of forward press imparted by golfer 10 on the putter during the putting stroke. So, for example, if golfer 10 has a 3° forward press at impact with the golf ball, his or her putter should be customized to include a strike face with a 7° loft. It is known that golfer 10 will de-loft the 7° strike face by three degrees, resulting in the desired 4° loft at impact with the ball. Similarly, if golfer 10 has a rearward press, he or she is lofting the putter face from its original, desired 4° angle. Accordingly, the face of golfer 10's putter should be de-lofted by the amount of rearward press imparted by golfer 10. For example, if golfer 10 has a 3° rearward press at impact with the golf ball, his or her putter should be customized to include a strike face with a 1° loft. It is known that golfer 10 will loft the 1° strike face by three degrees, resulting in the desired 4° loft at impact with the ball.

An 86° angle is additionally disclosed in FIG. 4. This angle was drawn to correspond to the angle of the putter shaft just prior to initiation of the putter stroke, and allows a golfer to compare the position of his putter just prior to swing initiation with the position of his putter at impact with the golf ball. Such a comparison is advantageous as it allows the golfer, for example, to determine whether his wrists are hinging during the putting stroke. If the angular reading prior to the putting stroke differs from that obtained at impact with the golf ball, this would tend to indicate that a certain amount of wrist movement is occurring.

One skilled in the art will understand that although angle function 332 has been described in the context of a manually drawn angle, a software routine can be easily implemented to automate angle function 332. For example, the system can be programmed to automatically recognize, upon command, the putter shaft (either by color, shape, or by distinct markings placed at various predetermined locations on the shaft), and to determine the angle between the shaft and a horizontal plane. By automating angle function 332 in this fashion, any potential error introduced by the system operator in drawing the angle will be eliminated.

Screen 304 of FIG. 5 includes a ball side view still image, previously captured from camera 20, obtained immediately after the golf club has impacted the ball. By viewing ball side view images immediately following the point of club/ball impact (by for example forward step function 318), additional information may be obtained regarding the putting stroke of golfer 10. For example, by analyzing the performance of golf ball 12 once struck, it may be determined whether golfer 10 is "slicing" or "drawing" the golf ball. It may also be determined whether the golfer is properly keeping the club face square through impact or, alternatively, whether the golfer is opening or closing the club face through impact.

For a right handed golfer, "slicing" refers to those situations wherein the ball is imparted with a clockwise rotation, when viewed from the golfer's perspective, upon impact (for a left handed golfer, it would be a counter clockwise rotation). A sliced putt may result when the putting stroke starts outside the proper swing plane, and then proceeds to move towards the inside of the swing plane upon impact with golf ball 12 (keeping the hands too "still" through impact may also result in, or exacerbate, a sliced shot). For a right handed golfer, "drawing" refers to those situations wherein the ball is imparted with a counter-clockwise rotation, when viewed from the golfer's perspective, upon impact (for a left handed golfer, it would be a clockwise rotation). A drawn putt may result when the putting stroke starts inside the proper swing plane, and then proceeds to move towards the outside of the swing plane upon impact with the golf ball (over aggressive hand movement while closing the club face at impact may also result in, or exacerbate, a drawn shot). Slicing or drawing of the golf ball during the putting stroke is undesirable, as it results in a loss of putting accuracy, both in terms of direction and in terms of distance. A failure to keep the club face square through impact is undesirable for these same reasons.

Once it has been determined whether golfer 10 is slicing or drawing the golf ball when putting, and to what extent, or whether a golfer is keeping the club face square through impact, this information may be used to customize the putter of golfer 10 in accordance with his or her individual swing characteristics. Specifically, if golfer 10 is slicing the ball or keeping the clubface open through impact, his or her putter should be configured with more "offset". Offset refers to a putter configuration wherein the strikeface is set back (or forward as the case may be) of the putter shaft. By offsetting the strike face back or rearward of the putter shaft in an exaggerated fashion, the golfer is provided with more time to square the club face prior to impact with the golf ball, thus reducing the amount of slice imparted on the golf ball.

Alternatively, if golfer 10 is drawing the golf ball or keeping the clubface closed through impact, the golf club should be configured with less offset, or no offset, so as to give the golfer less time to square the club face at impact, thus reducing the amount of-draw imparted on the golf ball.

Ball side view still image of FIG. 5, obtained immediately after the golf club has impacted the ball, may also be used to confirm the angular measurements obtained in conjunction with the shaft side view still image of FIG. 4. Using angle function 332 in the same fashion as described in the context of FIG. 4, the angle of strike face 822 at impact with the golf ball may be determined. The 92° angle shown in FIG. 5, for example, confirms that golfer 10 is forward pressing the putter by 2°, as a model 4° angle of the club face at impact would result in an angular reading, taken from the strike face, of 94°.

Ball side view moving images following impact may also be used to confirm whether an appropriate loft of the putter strike face exists at impact. For example, it has been determined that for a 20 foot putt, the golf ball should preferably travel through the air, with no backspin, for approximately 9 inches when properly struck. If the ball is travelling through the air for more than 9 inches, with backspin, this tends to indicate that putter strike face 822 is too lofted at impact with the golf ball. If the ball travels less than 9 inches through the air, with immediate forward spin, this tends to indicate that the putter strike face 822 is not lofted enough at impact. In this fashion, the system operator can further confirm the status of the putter strike face at impact with golf ball 12.

Figure 6:
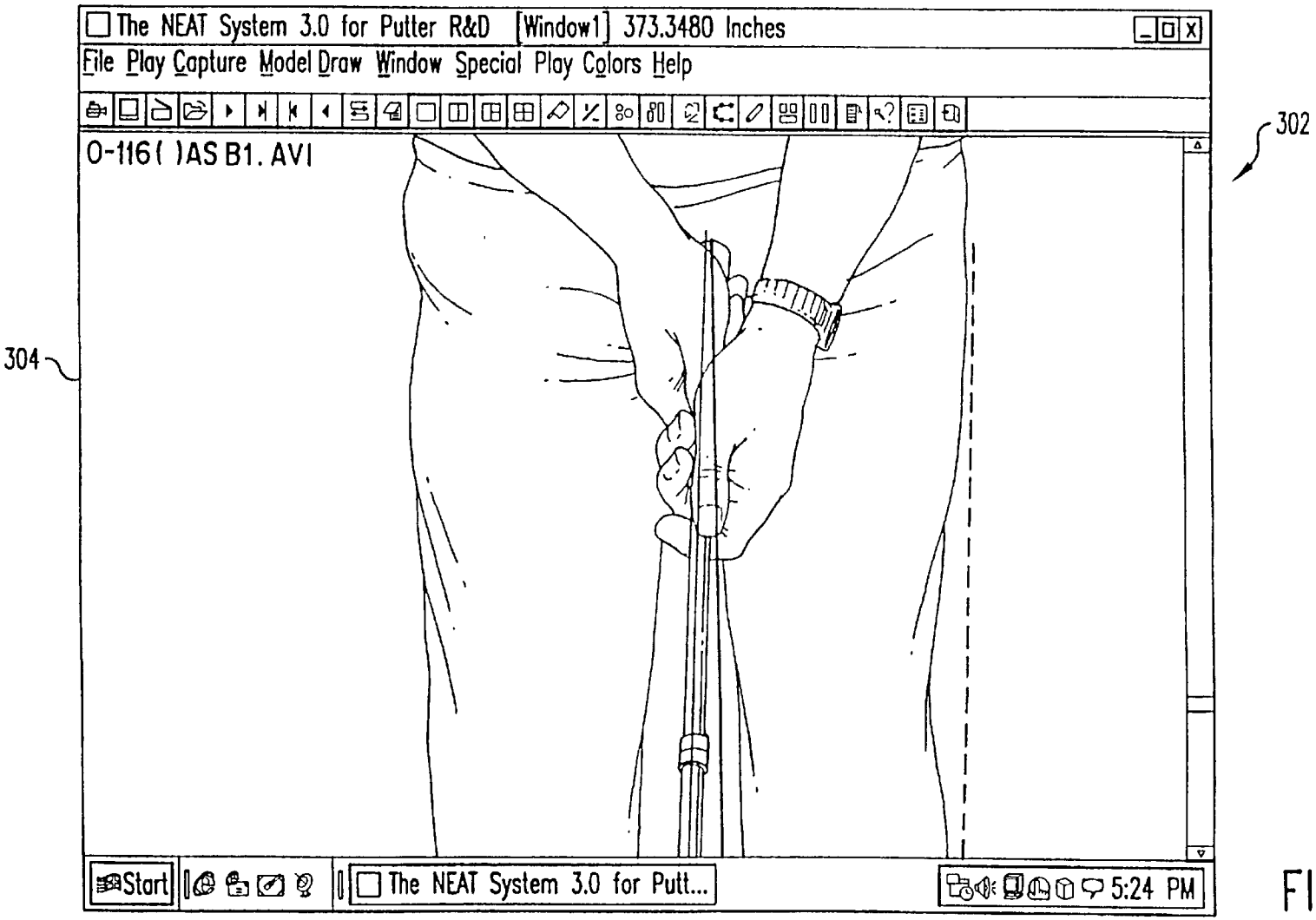
FIG. 6 is a computer display of a putter grip side view still image illustrating the method according to the present invention.

Screen 304 of FIG. 6 includes a putter grip side view still image, previously captured from camera 24, obtained immediately after the golf club has impacted the ball. By viewing putter grip side view images immediately prior to and then following the point of club/ball impact (by for example forward step function 318), it may be determined whether the wrists of golfer 10 are remaining still through impact, as is preferred, or whether the wrists are "breaking down" through impact. A "breaking down" of the wrists during the putting stroke refers to those instances wherein movement occurs at the wrist joints of golfer 10. It is well recognized that the desired putting stroke employs a back-and-forth pendulum movement largely at the shoulders, with no hinging or movement of the wrist during the putting stroke. If the wrists are moving, or "breaking down", during the stroke, this may disadvantageously result in a backward press of the strike face (if the wrists are used to move the club face forward of the golfer's hands prior to impact) or a forward press of the strike face (if the wrists hinge so as to allow the club face to drag behind the golfer's hands prior to impact). Using putter grip side view images to determine whether the wrists are breaking down, and if so, in what fashion, enables the user of the system to further confirm the angular readings obtained from the shaft and ball side view images of FIGS. 4 and 5, and to potentially pinpoint for the golfer the reason for those angular readings. So, for example, if it is determined from the angular readings off the shaft and strike face that golfer 10 has a two degree forward press, and then using the grip side view images, it is determined that the golfer is allowing the putter head to drag behind his hands by letting his wrists hinge, the findings from the angular readings have been confirmed and the cause of the forward press has been determined.

By viewing putter grip side view images immediately prior to and then following the point of club/ball impact (by for example forward step function 318), it may also be determined whether golfer 10 is leaning one way or the other (in other words, placing too much weight on one foot or the other) during the putting stroke. If golfer 10 is leaning toward the target during the stroke (i.e., placing too much weight on his left leg), this may disadvantageously result in a forward press of the strike face due to the steeper angle of attack imparted by the golfer's forward lean. If golfer 10 is leaning away from the target during the stroke (i.e., placing too much weight on his right, rear leg), this may disadvantageously result in a backward press of the strike face due to the more shallow angle of attack imparted by the golfer's rearward lean. Using putter grip side view images to determine whether the golfer is leaning, and if so, in what fashion, enables the user of the system to further confirm the angular readings obtained from the shaft and ball side view images of FIGS. 3 and 4, and to potentially pinpoint for the golfer the reason for those angular readings. So, for example, if it is determined from the angular readings off the shaft and strike face that golfer 10 has a two degree forward press, and then using the grip side view images, it is determined that although the golfer's wrists are remaining still, golfer 10 is leaning forward on his left leg, the findings from the angular readings have been confirmed and the cause of the forward press has been determined.

Figure 7:
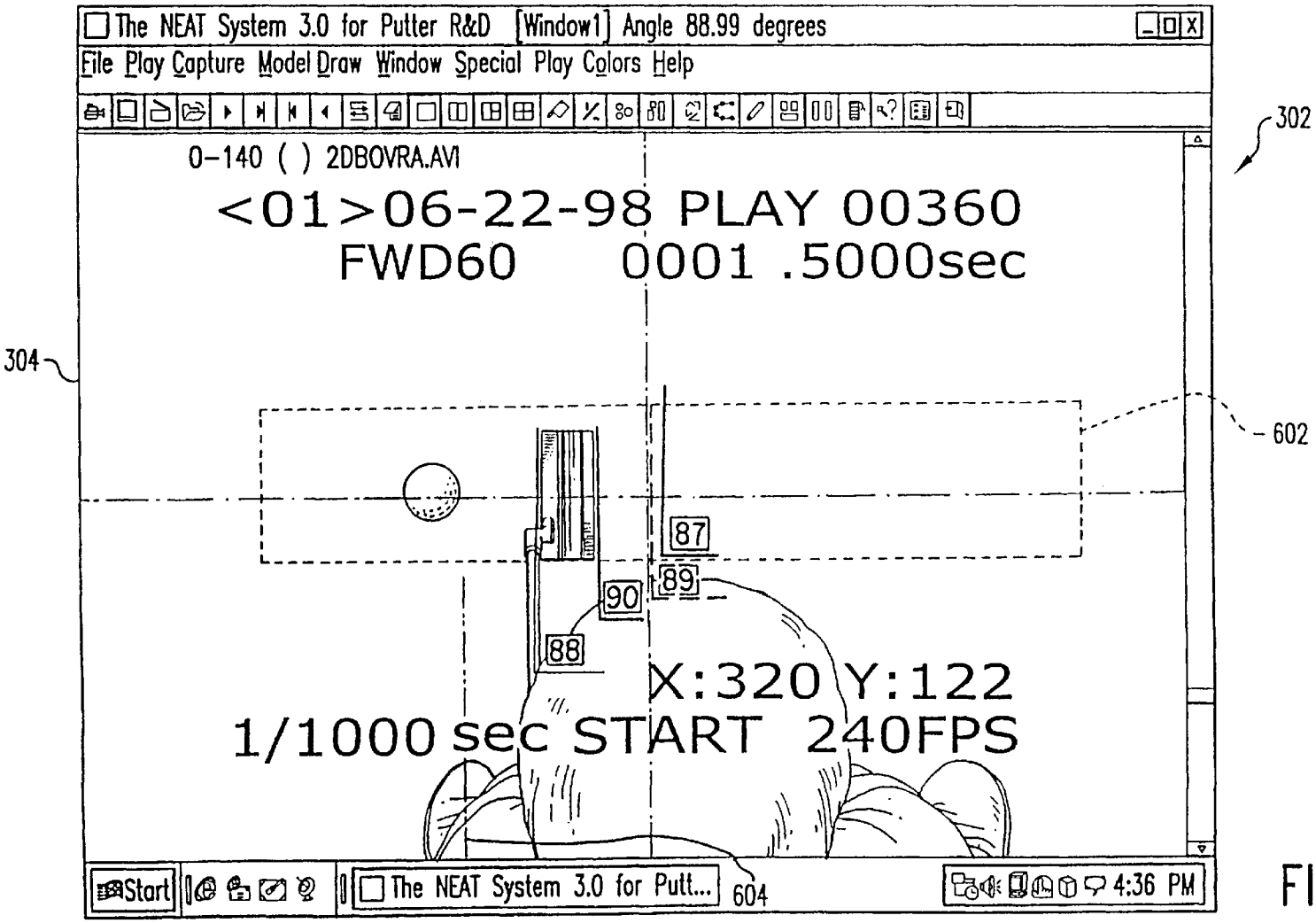
FIG. 7 is a computer display of an overhead view still image illustrating the method according to the present invention.

Screen 304 of FIG. 7 includes an overhead view still image, previously captured from camera 26, obtained immediately after the golf club has impacted the ball. By viewing overhead view images immediately prior to and then following the point of club/ball impact (using for example forward step function 318), it may be determined whether golfer 10 is tracking the putter on the appropriate swing plane or line.

More particularly, using rectangle function 330 and angle function 332 of the system, a rectangle 602 may be drawn around the putter head with a rectangle width approximately corresponding to the length of the putter head, and with a rectangle length approximately corresponding to the length of the putting stroke. By stepping through the putting stroke (using forward step function 318 and reverse step function 322) while rectangle 602 is superimposed over screen 304, and by drawing angles corresponding to the putter face at various intervals within the stroke (see, for example, the exemplary angles—87°, 89°, 90°, and 88°—set forth in FIG. 7), it may be determined if golfer 10 is keeping the golf club on the appropriate swing plane, or alternatively, if golfer 10 is going inside or outside that swing plane. If golfer 10 is taking the putter inside the appropriate swing plane on his back swing, golfer 10 is likely either to keep the putter face open at impact (resulting in a putt that will miss to the right), or to draw the golf ball upon impact (resulting in inaccurate putting direction and distance). If golfer 10 is taking the putter outside the appropriate swing plane on his back swing, golfer 10 is likely either to keep the putter face closed at impact (resulting in a putt that will miss to the left), or to slice the golf ball upon impact (resulting in inaccurate putting direction and distance).

Once it has been determined whether golfer 10 is deviating from the appropriate swing plane, this information may be used to customize a putter for golfer 10 in accordance with his or her individual swing characteristics. Specifically, if golfer 10 is bringing the golf club outside the appropriate swing plane during the backstroke, his or her putter should be configured with more "offset" for those reasons previously discussed. Alternatively, if golfer 10 is bringing the putter inside the appropriate swing plane during the backstroke, the golf club should be configured with less offset or no offset, also for those reasons previously discussed.

Overhead view image of FIG. 7 may also be used to determine the amount of head movement golfer 10 has during his or her putting stroke. Using line function 326 (by depressing button 326 in FIG. 4), a line 604 may be drawn along the left edge of golfer 10's head just prior to the start of his or her putting stroke. The putting stroke may then be stepped through, frame by frame, until the point in the putting stroke has been reached where the club head contacts the golf ball. Line function 326 may then be used to measure the distance, if any, the left edge of golfer 10's head has moved from its initial position.

It must additionally be noted that, because the system has no way of knowing the actual distance between points in screen 304 (because golfer 10 and the putter are not reproduced to scale on the screen), distances must first be calibrated. To do this, a line is drawn between two points, between which the distance is known (for example, the diameter of the ball, which is known to be 1.68 inches). The system is then instructed by the system operator as to what distance that is. Using this calibration, any line can be drawn on the screen using line function 326, the distance of which the system will now be able to compute (although this distance will not be the exact distance, given the fact that the golf ball, against which the distance is calibrated, appears smaller on the screen than the golfer's head, as it is farther away from the video camera). In this fashion, it can be determined just how far the golfer's head is moving during the putting stroke.

If golfer 10 is moving his or her head backward (or forward) more than 1½ inches during the stroke, the head movement will in most cases cause the putter club head to lift off the ground, resulting in a steeper angle of attack and a de-lofted strike face at impact. This information can be used to further confirm the results of the angular readings from the shaft and strike face (discussed in conjunction with FIGS. 3 and 4), and to allow the system operator to pinpoint the reason why golfer 10 has de-lofted the club at impact.

It must additionally be noted that circle function 328 may be used, in the place of line function 326, to compute the distance a golfer's head moves during the putting stroke. Using circle function 328 (by depressing button 328 in FIG. 4), a circle may be drawn around golfer 10's head just prior to the start of his or her putting stroke. The putting stroke may then be stepped through, frame by frame, until the point in the putting stroke has been reached where the putter head contacts the golf ball. Line function 326 may then be used to measure the distance from one side of the golfer's head to the point on the circle representing the position where that same side was at the initiation of the putting stroke.

Figure 8:
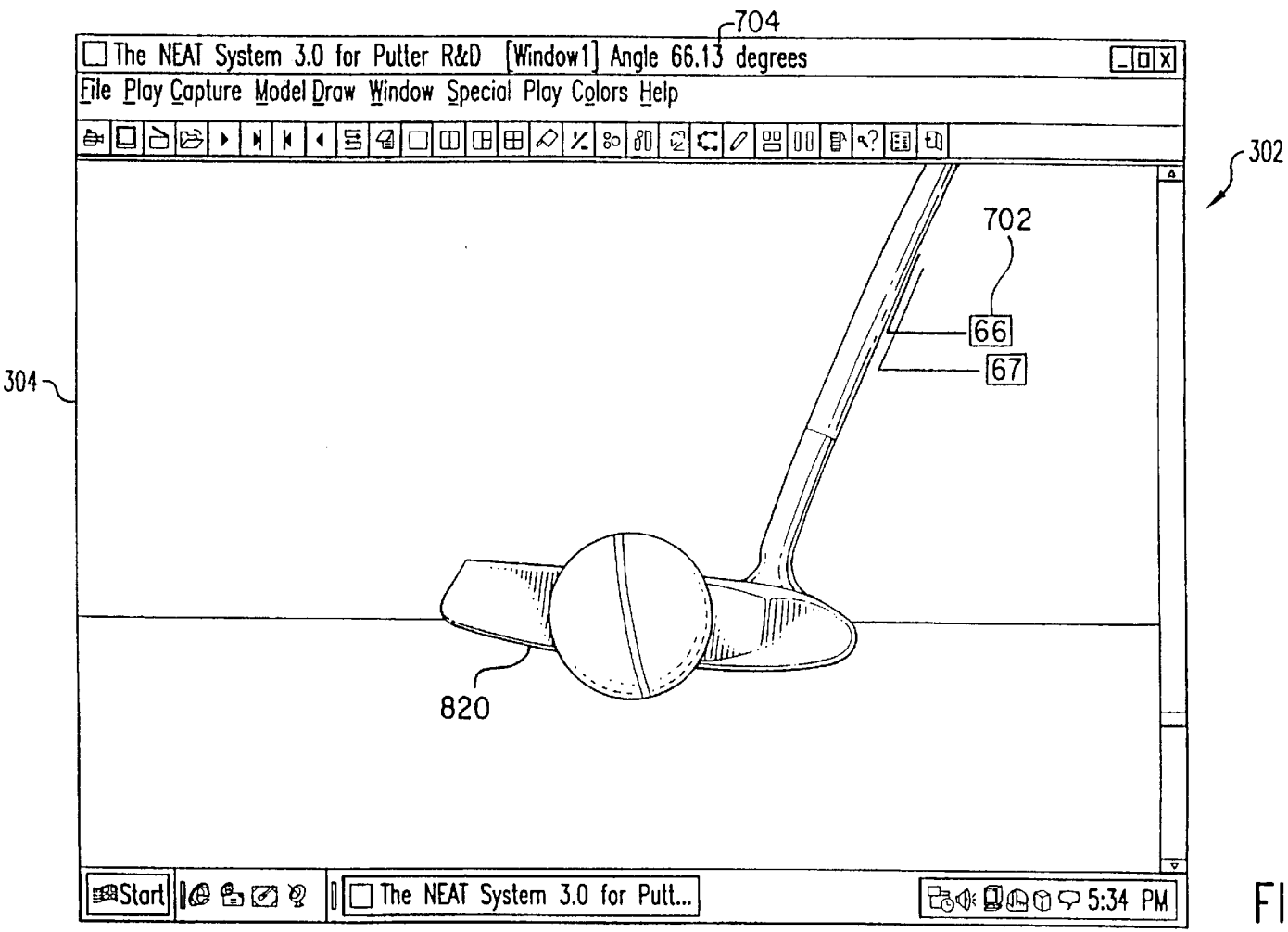
FIG. 8 is a computer display of a forward facing view still image illustrating the method according to the present invention.

Screen 304 of FIG. 8 includes a forward facing view still image, previously captured from camera 28, obtained immediately after the golf club has impacted the ball. Using angle function 332, the angle of sole 820 upon the putter's impact with the ball may be determined from this still image. As mentioned, angle function 332 allows the user to draw two lines over image screen 304, said two lines connecting to form a vertex. The system will then compute the precise angle formed between these two lines. Accordingly, to determine the sole angle at impact, the user first draws a line along the shaft of the putter, and then connects to that line a horizontal line representing the putting surface. The putting analysis system will then compute and display the angle between these two lines, which represents the shaft angle at impact with the ball. An example of two such lines, and the resulting angular read-out 702 (66 degrees in FIG. 8), can be seen in video image screen 304 of FIG. 8. This angular reading is also displayed to two-decimal place accuracy (66.13 degrees in FIG. 8), at a second position 704 on the computer screen. This shaft angle (66 degrees in FIG. 8) may then be compared to the shaft angle when the sole is parallel to the putting surface (generally 71 degrees) to determine the putter sole angle at impact, which in this example would be 5 degrees.

More specifically, using the obtained angular reading from the putter shaft, it may be determined whether the lie of the putter with known dimensions is too upright or too flat for golfer 10's individual swing characteristics. As mentioned, the common lie angle for a putter is 71 degrees. If, however, it is determined from angular read-outs 702 and 704 that golfer 10 is striking the ball with the toe of the putter 5° from horizontal (that is, the toe is above the heel at a 5° angle from horizontal as shown in FIG. 8), then the putter of golfer 10 may be customized to include a 66° lie. Similarly, if it is determined from angular read-outs 702 and 704 that golfer 10 is striking the ball with the heel of the putter 5° from horizontal (that is, the heel is above the toe at a 5° angle from horizontal), then the putter of golfer 10 may be customized to include a 76° lie.

One skilled in the art will appreciate that, once golfer 10's putting stroke has been analyzed, and once golfer 10 has been custom fit with a putter based upon this analysis, steps 50 through 62 (as shown in FIG. 2) may again be followed—this time using the custom-fit putter as the putter of known dimensions discussed in conjunction with step 50. By re-analyzing the golfer's putting stroke in this fashion, it may be determined whether the custom fit putter is providing golfer 10, as expected, with desirable swing results.

Various embodiments of the invention have been described. The descriptions are offered by way of illustration, not limitation. Thus, it will be apparent to those skilled in the art that modifications may be made to the invention as described without departing from the scope of the claims set out below.

What is claimed is:

1. A putter analysis system comprising:

a putting surface comprising a ball striking location and a hole located approximately 20 feet from the ball striking location;

a ball side view camera located proximate the ground on an opposite side of a golfer applying a putting stroke, the ball side view camera being a high speed camera capable of recording images at speeds greater than or equal to 240 frames per second and being located to capture images of a ball movement after being struck by a putter;

video image storage means for receiving and storing video images from the ball side camera;

a display monitor coupled to the video image storage means for displaying the images of the ball after being struck by the putter; and means of analyzing the video images of the ball displayed by the display monitor to determine whether the putter has an appropriate putter loft for the golfer applying the putting stroke.

2. The putter analysis system of claim 1, wherein the ball side view camera is further located at a position to record at least about 9 inches of ball movement after being struck by the putter.

3. A putter analysis system comprising:

a putting surface comprising a ball striking location;

a ball side view camera located proximate the ground on an opposite side of a golfer applying a putting stroke, the ball side view camera being a high speed camera capable of recording images at speeds greater than or equal to 240 frames per second and being located to capture images of a ball movement after being struck by a putter;

a forward facing camera being located at least about 2 inches above the ground in a golfer's putting line;

video image storage means for receiving and storing video images from the ball side camera;

a display monitor coupled to the video image storage means for displaying the images of the ball after being struck by the putter; and means of analyzing the video images of the ball displayed by the display monitor to determine whether the putter has an appropriate putter loft for the golfer applying the putting stroke.

4. The putter analysis system of claim 3, wherein the forward facing camera is located at about 12 feet from the striking location in the golfer's putting line.

5. The putter analysis system of claim 1, further comprising a ball having colored bands for tracking movement of the ball.

6. The putter analysis system of claim 5, wherein the bands are dark-colored bands placed along two perpendicular circumferences of the ball.

7. The putter analysis system of claim 1, further comprising:

a shaft side view camera placed above the ball side view camera for obtaining images of a putter shaft during impact; and means for determining the putter loft during impact from the putter shaft images.

8. The putter analysis system of claim 1, further comprising a grip side view camera being placed above the ball side view camera for obtaining images of a golfer's grip during a putting stroke.

9. A putter analysis system comprising:

a putting surface including a ball striking location;

a forward facing camera located proximate the ground substantially in a golfer's putting line, the forward facing camera being a high speed camera capable of recording images at speeds greater than or equal to 240 frames per second and being located to capture images of a ball movement after being struck by a putter;

video image storage means for receiving and storing video images from the ball side camera;

a display monitor coupled to the video image storage means for displaying the images of the ball after being struck by the putter; and means for analyzing the video images of the ball displayed by the display monitor to determine whether the putter has an appropriate putter configuration for the golfer applying the putting stroke.

10. The putter analysis system of claim 9, wherein the putter configuration is selected from the group of an amount of offset, a lie angle and putter loft.

11. The putter analysis system of claim 9, further comprising a ball having dark-colored bands placed along two perpendicular circumferences.

12. A method of fitting a golfer to a putter comprising the steps of:

providing a first putter having predetermined dimensions;

providing a golf ball having a plurality of dark-colored bands;

providing a ball side view camera proximate the ground on an opposite side of the golfer applying a putting stroke, the ball side view camera being a high speed camera capable of recording images at speeds greater than or equal to 240 frames per second and being located to capture images of ball movement after being struck by the first putter;

providing a forward facing camera located proximate the ground substantially in the golfer's putting line;

having the golfer impact the ball with the putter;

recording images of the impact and the ball after impact; and analyzing the images to determine the appropriate putter dimensions for the golfer.

13. The method of claim 12, further comprising the step of:

providing a forward facing camera proximate the ground substantially in a putting line of the golfer applying a putting stroke, the forward facing camera being a high speed camera capable of recording images at speeds greater than or equal to 240 frames per second and being located to capture images of the impact and ball movement after being struck by the first putter.

* * * * *